US009873015B2

(12) United States Patent
Jolly

(10) Patent No.: US 9,873,015 B2
(45) **Date of Patent: *Jan. 23, 2018**

(54) EXERCISE RING FOR IMPROVING STRENGTH AND FLEXIBILITY OF A BODY PART

(75) Inventor: Michael Jolly, Redondo Beach, CA (US)

(73) Assignee: Mission Competition Fitness Equipment, Redondo Beach, CA (US)

( * ) Notice: Subject to any disclaimer, the term of this patent is extended or adjusted under 35 U.S.C. 154(b) by 229 days.

This patent is subject to a terminal disclaimer.

(21) Appl. No.: 13/457,371

(22) Filed: Apr. 26, 2012

(65) Prior Publication Data

US 2013/0085046 A1 Apr. 4, 2013

Related U.S. Application Data

(63) Continuation-in-part of application No. 13/252,004, filed on Oct. 3, 2011.

(51) Int. Cl.
*A63B 23/025* (2006.01)
*A63B 21/008* (2006.01)
(Continued)

(52) U.S. Cl.
CPC ..... *A63B 23/025* (2013.01); *A63B 21/4003* (2015.10); *A63B 21/4007* (2015.10);
(Continued)

(58) Field of Classification Search
CPC ..... A63B 21/0442; A63B 21/0552; A63B 21/1407; A63B 21/1415; A63B 21/1419;
(Continued)

(56) References Cited

U.S. PATENT DOCUMENTS 2,496,748 A * 2/1950 Pond ..... 482/43
3,006,645 A * 10/1961 Frazier ..... 482/43
(Continued)

FOREIGN PATENT DOCUMENTS

JP 07017261 U 3/1995
KR 1020010026303 A 4/2001
WO WO 9412242 A1 * 6/1994

OTHER PUBLICATIONS

Preliminary Report for related PCT Patent Application No. PCT/US2012/035865, dated Apr. 8, 2014, 6 pages.
(Continued)

*Primary Examiner* — Gregory Winter
(74) *Attorney, Agent, or Firm* — Kriby B. Drake; Klemchuk LLP

(57) ABSTRACT

The present invention provides an apparatus and method for exercising a body part from any angle with variable resistance while taking up minimal floor space. The apparatus improves the ability of athletes, including football players and wrestlers, to better prepare for contact from any angle while engaged in their sport. The apparatus includes a ring having a guide track therein. A first end of a resistive band may be received by and wrapped around the guide track while encompassing a source of resistance at another end. The source of resistance may be other gym equipment including a pulley. Alternatively, the guide track may be on an inner surface of a stationary outer ring configured to receive a bearing disposed on an outer surface of a rotatable inner ring. The inner ring may include an inflatable bladder disposed along its inside to provide a perfect fit.

12 Claims, 10 Drawing Sheets

(51) Int. Cl.

| | |
|---|---|
| *A63B 21/02* | (2006.01) |
| *A63B 21/04* | (2006.01) |
| *A63B 21/055* | (2006.01) |
| *A63B 21/072* | (2006.01) |
| *A63B 21/28* | (2006.01) |
| *A63B 23/04* | (2006.01) |
| *A63B 23/12* | (2006.01) |
| *A63B 23/00* | (2006.01) |
| *A63B 21/062* | (2006.01) |
| *A63B 21/00* | (2006.01) |

(52) U.S. Cl.

CPC ..... *A63B 21/4009* (2015.10); *A63B 21/0088* (2013.01); *A63B 21/023* (2013.01); *A63B 21/0442* (2013.01); *A63B 21/0552* (2013.01); *A63B 21/0628* (2015.10); *A63B 21/072* (2013.01); *A63B 21/28* (2013.01); *A63B 21/4043* (2015.10); *A63B 23/0482* (2013.01); *A63B 23/1236* (2013.01); *A63B 2023/006* (2013.01); *A63B 2209/10* (2013.01); *A63B 2225/62* (2013.01); *A63B 2243/007* (2013.01)

(58) Field of Classification Search

CPC ..... A63B 21/1484; A63B 21/1488; A63B 23/025; A63B 21/0407; A63B 21/0435; A63B 21/4003; A63B 21/4007; A63B 21/4009–21/4025; A63B 21/4045; A63B 21/4049; A63B 19/00–19/04; A63B 21/0608; A63B 22/20; A63B 22/208; A63B 2022/206; A63B 23/02; A63B 23/0482

USPC ..... 482/10, 43, 101, 105, 110, 114, 115, 482/121–130, 139, 904; 601/39; 119/770, 792, 795–798, 856, 857, 863; 446/236, 247; 182/36–38

See application file for complete search history.

(56) References Cited

U.S. PATENT DOCUMENTS

| | | | | | |
|---|---|---|---|---|---|
| 3,866,910 | A | | 2/1975 | Herring | |
| 3,868,786 | A | * | 3/1975 | Lippe | A01K 27/001 446/28 |
| 4,052,982 | A | * | 10/1977 | Ozeryansky | 601/121 |
| 4,111,415 | A | * | 9/1978 | Reitano | 482/10 |
| 4,340,215 | A | * | 7/1982 | Murphy | A61H 3/008 104/62 |
| 4,832,333 | A | | 5/1989 | Lockett | |
| 4,988,093 | A | * | 1/1991 | Forrest et al. | 482/10 |
| 5,271,481 | A | * | 12/1993 | Rich | A62B 35/0081 182/3 |
| 5,509,869 | A | * | 4/1996 | Miller | 482/10 |
| 5,709,637 | A | * | 1/1998 | Gow et al. | 482/129 |
| 5,984,836 | A | * | 11/1999 | Casali | 482/10 |
| 6,106,437 | A | * | 8/2000 | Brooks | 482/10 |
| 6,217,482 | B1 | * | 4/2001 | Yoo et al. | 482/10 |
| 6,440,047 | B1 | * | 8/2002 | Huang | 482/148 |
| 6,592,536 | B1 | * | 7/2003 | Argenta | 602/17 |
| 7,077,794 | B1 | | 7/2006 | Bray | |
| 7,104,926 | B2 | | 9/2006 | Carlson | |
| 7,232,357 | B2 | * | 6/2007 | Chen | A63B 19/00 446/236 |
| 7,390,286 | B1 | | 6/2008 | Edgeton | |
| 7,468,019 | B2 | | 12/2008 | Zylstra | |
| 9,463,369 | B2 | * | 10/2016 | Ebsen | A63B 69/0064 |
| 9,687,688 | B2 | * | 6/2017 | Hsiao | A63B 19/00 |
| 2002/0100109 | A1 | * | 8/2002 | Hoop | A41D 13/0512 2/425 |
| 2002/0177507 | A1 | | 11/2002 | Carbone | |
| 2006/0063652 | A1 | * | 3/2006 | Berman et al. | 482/139 |
| 2008/0116654 | A1 | * | 5/2008 | Cooney | A63B 19/02 280/206 |
| 2008/0274858 | A1 | | 11/2008 | Flavell et al. | |
| 2009/0062087 | A1 | * | 3/2009 | Poppinga | 482/124 |
| 2010/0323861 | A1 | * | 12/2010 | Karwan | A47C 7/40 482/145 |
| 2016/0035228 | A1 | * | 2/2016 | Cakmak | A61H 3/008 434/247 |

OTHER PUBLICATIONS

International Search Report for related PCT Patent Application No. PCT/US2012/035865, dated Nov. 23, 2012, 3 pages.

Written Opinion for related PCT Patent Application No. PCT/US2012/035865, dated Nov. 23, 2012, 5 pages.

* cited by examiner

FIG. 1
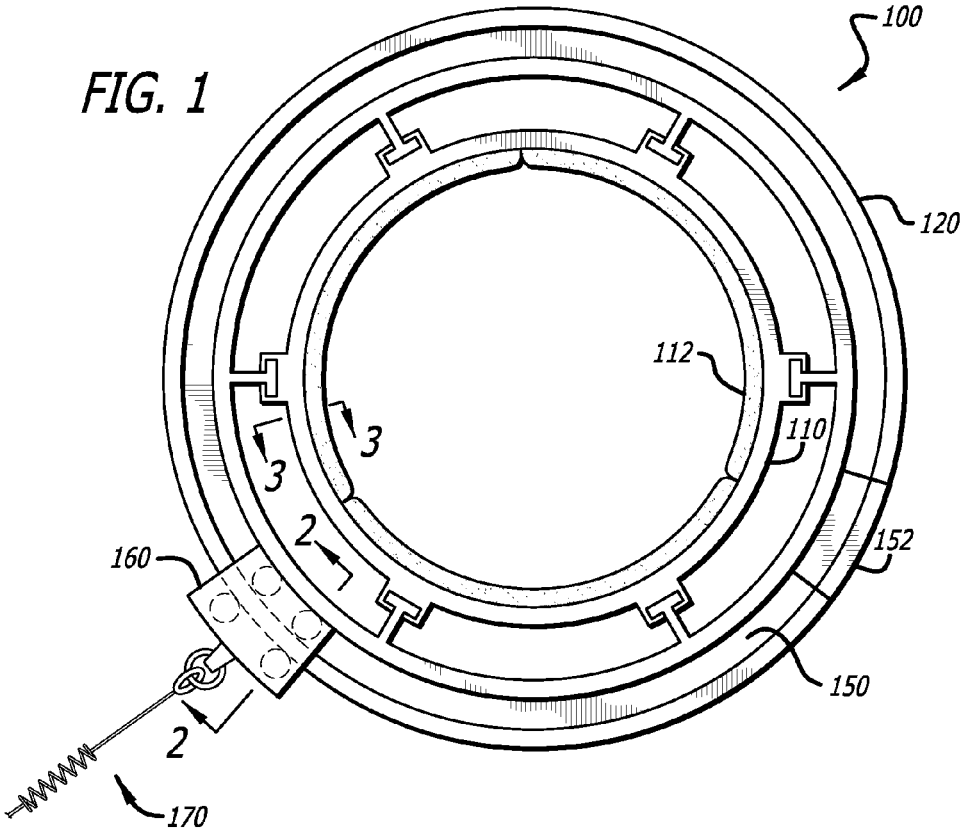
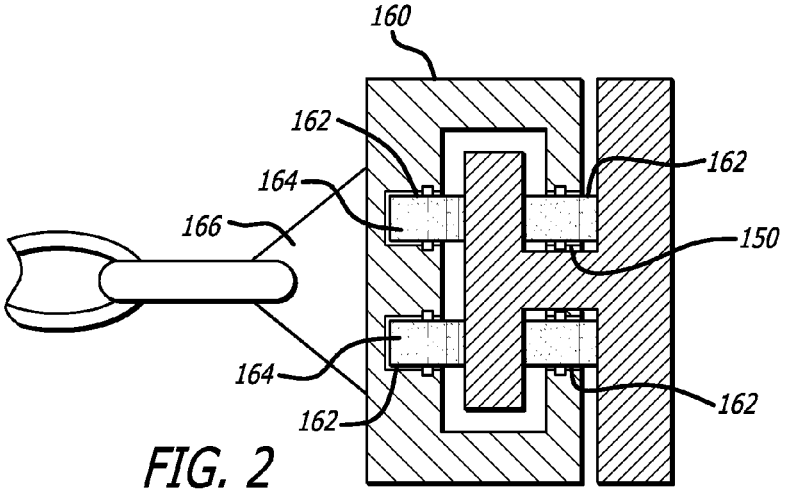
FIG. 2

FIG. 9
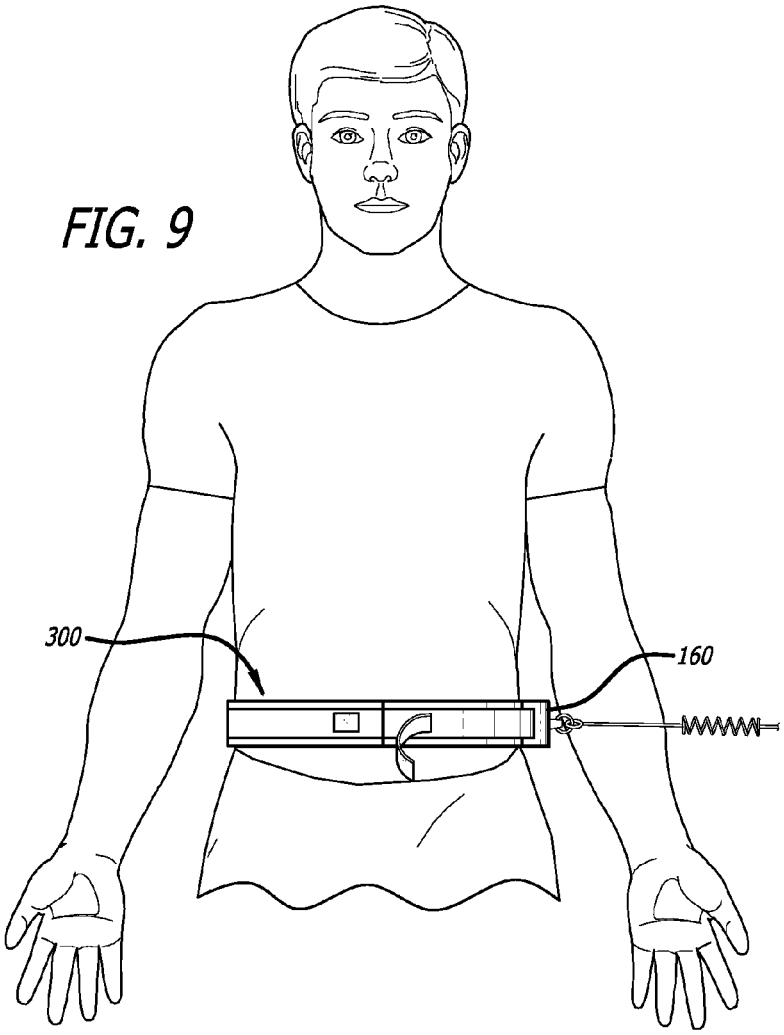
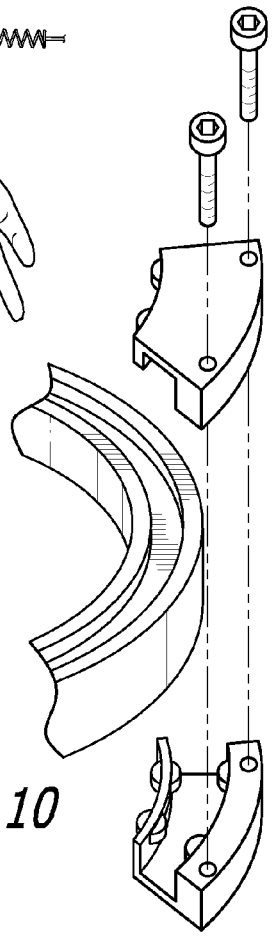
FIG. 10

EXERCISE RING FOR IMPROVING STRENGTH AND FLEXIBILITY OF A BODY PART

CROSS-REFERENCES TO RELATED APPLICATIONS

This application is a continuation-in-part of co-pending application Ser. No. 13/252,004 filed on Oct. 3, 2011, which is incorporated by reference in its entirety.

FIELD OF THE INVENTION

The present invention is generally directed to apparatuses and methods for exercising the human body to improve agility, balance, coordination, flexibility, and strength. One application of the invention is particularly directed to an apparatus and a method for exercising the human neck and related muscles. Other applications of the invention are directed to an apparatus and a method for exercising the chest, the waist, the oblique side muscles, the torso, the legs, the gluteus maximus or glutes, and almost any other body part from any angle with variable resistance while taking up minimal floor space.

BACKGROUND

Traditional gym equipment for exercising, and available equipment for exercising the neck, legs, and gluteus maximus, in particular, takes up a large amount of floor space which can be very valuable in a gym environment. Gym space must be bought or leased and more space taken up by one piece of equipment limits the number of other pieces of equipment that may fit into the gym. The total amount of equipment available in turn limits the number of people that can comfortably workout at the same time and this can influence the optimal number of memberships sold. Equipment that takes up little floor space provides advantages of being able to fit more equipment into the gym so that more people can workout simultaneously and more memberships may be sold, increasing revenues for the fitness club.

Most gyms offer some form of group exercise classes which tend to be particularly popular to keep people motivated. New varieties of group exercise classes are continually emerging in an effort to keep exercise fun and interesting. Some types of group exercise classes provide some equipment with which the individual class members each work with independently while following a class instructor. For example, there are aerobic step classes in which each member has a step to work with and other strength training classes in which each member has a set of weights. For group classes incorporating some work with gym equipment, given the potentially large number of attendees or class members it is desirable to have reasonably priced equipment for class members to use that provides a myriad of exercise possibilities so that the class instructor can be creative and provide an effective workout.

Traditional gym machines for exercising the neck, legs, gluteus maximus, and other body parts are not ideal because they only workout the body part at limited angles with a limited range of motion. In many sports, especially contact sports like football, athletes may be subjected to force from any angle. Accordingly, exercise machines that only exercise the neck, legs, gluteus maximus, or other body part at limited angles do not adequately prepare and protect the athlete for the often unpredictable environment to which they are subjected on the playing field.

The cervical spine and muscles of the neck of the human body are extremely complex, such that the movement of the head with respect to the body requires an integrated movement of many muscles in coordination with the articulation of the cervical spine. As such, many people suffer from conditions resulting from improper orientation of the cervical spine, imbalance of the posterior cervical muscles and compression of the spine. These conditions may result from faulty or sustained postures, trauma, emotional stress and the like.

Indeed, many people exhibit a variety of discomforts caused by the misalignment of the cervical spine and imbalance of the associated muscles. For example, localized pain, headaches, decreased circulation and soreness, to name a few, decrease the quality of life of persons suffering from these conditions. These conditions have an associated cycle of pain and muscle contraction that leads to decreased function and potential soft tissue dysfunction.

The most common way to attempt to alleviate this pain is with medication. Another way to alleviate pain in this area is by strengthening and stretching the muscles in or around the head, neck, and shoulders. More specifically, the group of muscles targeted includes longissimus capitis, suboccipital, emispmalis capitis, longissimus cervicis and levator scapula. Free weights, dumbbells, and exercise/weight machines are known for building and training various muscles in the body. Despite the wide variety of exercise strengthening devices, neck muscle strengthening devices for strengthening the core muscles of the neck are not well known or widely used.

At some gyms the available floor equipment for exercising the legs and gluteus maximus is crowded and quickly filled. It is counterproductive to the goal of staying in motion to stand around waiting for desired equipment to become available.

It would be desirable to provide an apparatus for exercising the legs and gluteus maximus that an exerciser can use in an open space, empty studio, or at home, instead of waiting for gym floor equipment to become available, and that provides a greater number of possibilities for exercising the muscles from new angles to keep muscles continually challenged.

It would be desirable to provide an easy to use apparatus for strengthening and stretching the muscles of the head, neck, spine, shoulder, upper back, torso, legs, gluteus maximus, and others at any angle with variable resistance and variable size settings to accommodate a variety of users that takes up minimal space on a gym floor. It would also be desirable to provide a size-adjustable apparatus that takes up minimal floor space and can be interchangeably engaged with various sources of resistance for exercising a selected body part at any angle, including the chest, back, oblique side muscles, torso, abdominals, arms, legs, gluteus maximus, and any other body part. The present invention meets these and other needs.

SUMMARY OF THE INVENTION

One of several objectives of the present invention is to provide an apparatus for strengthening and stretching the muscles of the neck and related muscle groups at any angle or at several angles. A strong neck is more effective than a weak neck at dissipating violent force from contact such as that which occurs in athletics. The greater force dissipation made possible by a neck strengthened through exercising with the devices provided herein as an adjunct to a neck training program reduces the occurrence and severity of neck injuries and concussions.

To accomplish this objective, the apparatus includes two rings, an outer halo ring and an inner head ring, the latter configured to fit around a user's head at the forehead level. The inner head ring is provided in a variety of different sizes to accommodate a variety of users having heads of different sizes. The outer halo ring fits around the inner head ring and has a guide track along an outer surface thereof. The guide track around the outer periphery of the outer halo ring is configured to accommodate a car riding along the guide track in a substantially circular motion around the user's forehead thereby enabling the user to move freely to exercise the neck from any angle and from several different angles.

The guide track on the outer halo ring may include a protrusion or a groove that complements a corresponding structure on the car. A section of the outer halo ring may be removable in order to initially mount the car onto the outer halo ring, and to remove the car from the outer halo ring. The car has a first end with a structure that may include wheels or another mechanism for moving (e.g. rolling, gliding, and the like) along the guide track on the outer halo ring. At a second end of the car opposite to the first end having structure that rides along the guide track is a different structure configured for attachment of the car to a source of resistance. For example, the different structure at the second end for attachment to a source of resistance may simply be a hole through which a source of resistance can be hooked, looped, or otherwise attached. The structure that provides resistance may include a bungee cord, a kettlebell, an adjustable cable cross over machine, springs of different tensions, a cable attached to a weight machine, weighted exercise balls, a parachute or other device that utilizes wind resistance, or simply a wall or columnar structure.

The inner head ring attaches to the outer halo ring through a plurality of releasable attachment ports around the inner and outer rings. In this manner, a user may select the appropriate head ring to use based on the size of his/her head and then insert this fitted inner head ring into the uniform outer halo ring before beginning to exercise.

In addition to serving the needs of football players, wrestlers, and other athletes, the present invention may also find utility for the average individual seeking to stretch and strengthen the neck in order to reduce or minimize neck and upper back pain caused from everyday stress, tension, poor posture, problematic sleeping positions, and the like.

Another of several objectives of the present invention is to provide an apparatus for strengthening and stretching the muscles of other body parts at any angle or at several angles, including but not limited to the chest or pectorals, the back, the oblique muscles of the side, the abdominals, the buttocks, the legs, the arms, and any other body part. This is accomplished by adapting the basic structure discussed above for the neck to another body part. The main feature is a ring configured to securely fit around a body part, the ring having a guide track on an outer surface thereof configured to accommodate a moving car that connects the ring to a source of resistance. When appropriate a first inner body part ring may be provided in different sizes to fit around a body part and to fit inside a second uniform outer ring having a guide track around an outer periphery. In other cases, depending on the body part being exercised, it may be more appropriate to just have a single ring, which may be adjustable in size, that fits around the body part and has a guide track around its outer periphery.

In all of its various forms, the present invention is ideal for individuals and commercial gyms seeking to maximize the value of their equipment, machines, weights, springs and other resistance sources by purchasing adjustable interchangeable pieces and systems that can work together. The various embodiments of the present invention are also for those seeking to minimize the use of floor space as the basic apparatus of the present invention can be used with existing sources of resistance.

According to a first aspect of the present invention an apparatus for exercising a user's neck is provided including a headpiece element configured to be worn in a head region of a user, the headpiece element having a guide track therein. The apparatus also includes a car having an attachment port for connection to a source of resistance, the car configured to fit within the guide track of the headpiece element and to move along the guide track. As a user freely moves a neck or a head at any angle, the car adjusts its positioning along the guide track while maintaining a substantially stable position of the attachment port relative to the source of resistance, thereby enhancing a user's range of motion and comfort during exercise. The headpiece element of the apparatus may comprise a first ring configured to fit around a user's forehead. The first ring may leave a top of a user's head uncovered. The headpiece element may also include a second ring having a diameter larger than the first ring, the second ring configured for positioning outside of the first ring, the second ring having a structure along an inner perimeter for attaching to a corresponding structure along an outer perimeter of the first ring. The guide track of the headpiece element may be in the second ring. The guide track of the headpiece element may be along an outer perimeter of the second ring. The structure of the second ring for attaching to the corresponding structure of the first ring may include at least one protrusion and the corresponding structure of the first ring may include at least one groove configured to receive and mate with the protrusion. The structure of the second ring for attaching to the corresponding structure of the first ring may include at least one groove configured to receive and mate with the corresponding structure of at least one protrusion on the first ring. The structure of the second ring for attaching to the corresponding structure of the first ring may include a material available under the VELCRO® trademark and the corresponding structure of the first ring may include a mating strip of material available under the VELCRO® trademark. The structure of the second ring for attaching to the corresponding structure of the first ring may include a strip of a first material that adheres to another strip of a second material included in the corresponding structure of the first ring. The apparatus may also include a locking mechanism to secure the second ring to the first ring. The first ring may be available in a plurality of shapes or sizes, each first ring of the plurality configured to engage with the second ring. The car of the apparatus may have a wheel for moving along the guide track. The car of the apparatus may have a guide element having a lubricious surface for moving along the guide track. A section of the guide track of the apparatus may be removable for loading or unloading the car. The car may be configured to open up for receiving the guide track or for disengaging from the guide track during loading or unloading of the car. The first ring of the apparatus may have foam padding along an inner perimeter thereof, the foam padding configured to provide comfort when resting against a user's forehead. The first ring may also have a protective material covering the foam padding. The protective covering may be, for example, an artificial leather or "pleather" such as that available under the trademark NAUGAHYDE® for a composite of a knit fabric backing and a polyvinyl chloride (PVC) plastic coating. The apparatus may also include a source of resistance. The source of resistance for the apparatus may be selected from the group consisting of: a bungee cord, a kettlebell, a spring under tension, a cable cross over machine, a pilates machine, a weight stack, a weighted exercise ball, a pillar, a column, a hook on a wall, and a parachute.

According to a second aspect of the present invention a method of exercising the neck is provided including selecting a first head ring of an appropriate shape and size to securely fit a user's head, engaging the first head ring with a second ring, the second ring having a larger diameter than the first head ring and being outside the first head ring, and moving a head or a neck of a user at any angle, whereby the second ring is flexibly attached to a source of resistance through an adjustable connection such that as a user freely moves the adjustable connection responds to provide comfort and enhanced range of motion for a user.

According to a third aspect of the present invention an apparatus for exercising a body part is provided including a first ring configured to be worn around a body part of a user, the first ring having a guide track therein and a car having an attachment port for connection to a source of resistance, the car configured to fit within the guide track of the first ring and to move along the guide track. As a user freely moves a body part at any angle, the car adjusts its positioning along the guide track while maintaining a substantially stable position of the attachment port relative to the source of resistance, thereby enhancing a user's range of motion and comfort during exercise. The apparatus may also include a harness configured to be worn by a user, the harness having a plurality of structures along an outer perimeter thereof for attaching to a corresponding plurality of structures along an inner perimeter of the first ring. The apparatus may also include a harness configured to be worn by a user and a second ring received by the harness, the second ring having a plurality of structures along an outer perimeter thereof for attaching to a corresponding plurality of structures along an inner perimeter of the first ring.

According to a fourth aspect of the present invention an apparatus for exercising a body part is provided including a closed loop element configured to fit around a body part of a user, the closed loop element having an outer surface defining a guide track therein and a resistive band encompassing a portion of the guide track and also encompassing a source of resistance. The resistive band fits within the guide track. The configuration of the resistive band within the guide track may be such that a position of the resistive band within the guide track is responsively adjustable within the guide track as a user exercises but requiring deliberate adjustment to remove the resistive band from the guide track. The resistive band may be responsively adjustable by sliding within the guide track. The source of resistance may have a circular perimeter. The source of resistance may include a pulley. The pulley may be mounted along an axis pole and rotatable around the axis pole. The resistive band may be made of a rubberized material. The closed loop element may be a helmet. The closed loop element may be a forehead band. The closed loop element may be a belt. The closed loop element may be a torso brace. The apparatus may also include an inflatable ring inside the closed loop element, whereby an effective size of the closed loop element can be adjusted to properly fit a user's body part by inflating or deflating the inflatable ring.

According to a fifth aspect of the present invention an apparatus for exercising a body part is provided including a first inner ring configured to be worn around a body part of a user, the first inner ring having an outer surface and a bearing mounted to the outer surface, a second outer ring also configured to be worn around a body part of a user outside of the first inner ring, the second outer ring having an outer surface with an attachment port and an inner surface defining a guide track therein, the guide track configured to receive the bearing of the first inner ring, and a source of resistance attached to the attachment port on the outer surface of the outer ring. The second outer ring may be stationary and the first inner ring may be moveable, the first inner ring configured to rotate relative to the second outer ring as a body part rotates. The apparatus may further include an inflatable bladder inside the first inner ring, wherein an effective size of the apparatus is adjustable to properly fit a user's body part by inflating or deflating the inflatable bladder. The inflatable bladder may be at least a portion of the first inner ring itself. The inflatable bladder may be a separate element connected to an inner surface of the first inner ring. The second outer ring may include a top portion and a bottom portion, the separation of which reveals horizontal cross-sections, the top portion and the bottom portion being mated together to assemble the second outer ring. The attachment port is sandwiched between the top portion and the bottom portion of the second outer ring.

Other features and advantages of the present invention will become apparent from the following detailed description, taken in conjunction with the accompanying drawings, which illustrate, by way of example, the principles of the invention.

BRIEF DESCRIPTION OF THE DRAWINGS

FIG. 1 is a downward view of an embodiment for the headpiece element showing the inner head ring inside the outer halo ring.

FIG. 2 is a side view of an embodiment showing how the car is received in the guide track.

FIG. 9 is a frontal view of an individual wearing another embodiment of the exercise apparatus of the present invention incorporating a belt, for exercising other body parts including the legs and buttocks, around their waist with the apparatus connected to a source of resistance.

FIG. 10 is a perspective view of the car opening up to receive or disengage from the guide track during loading or unloading.

DETAILED DESCRIPTION OF THE PREFERRED EMBODIMENTS

Briefly, and in general terms, provided herein is an apparatus for strengthening and stretching muscles from any angle while taking up minimal floor space at a fitness club or home gym. The apparatus is adaptable for integration with other gym equipment including cable cross over machines, weight stacks, springs, pilates machines, weighted exercise balls, parachutes that take advantage of wind resistance, bungee cords, kettlebells, and the like through an attachment port on a car that rides freely along an outside perimeter of the apparatus.

Figure 5:
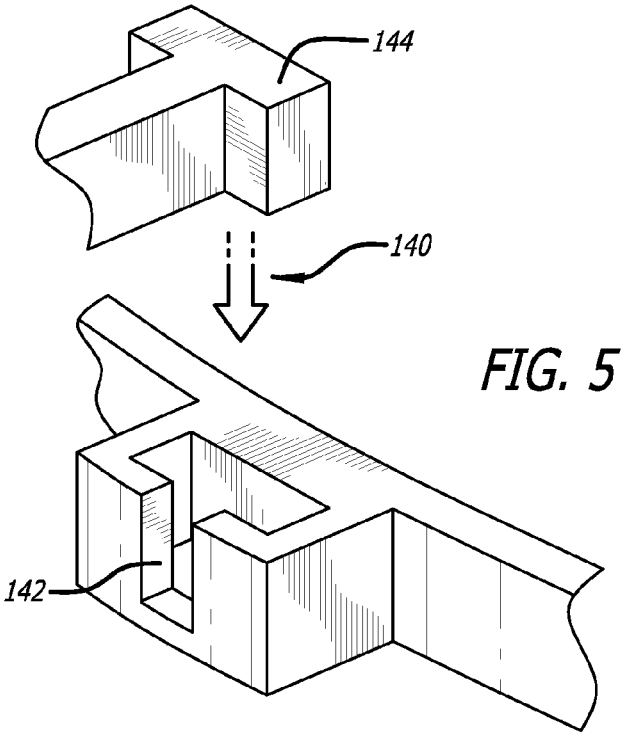
FIG. 5 is a perspective view of an embodiment showing one example of how the inner ring can engage with the outer ring.
Figure 6:
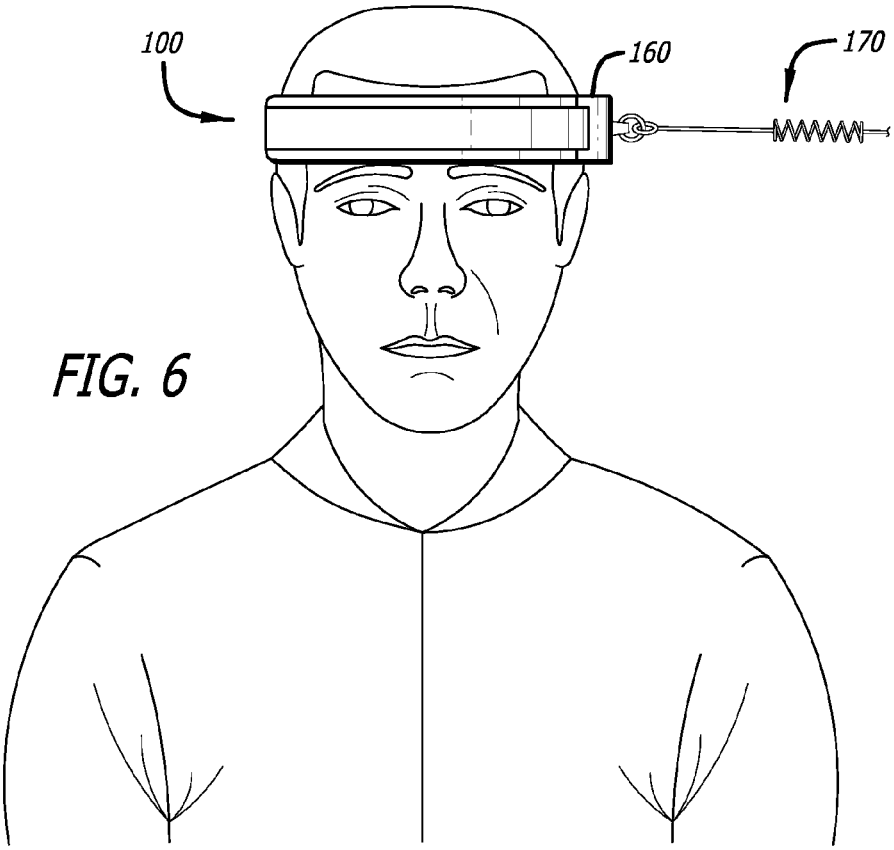
FIG. 6 is a frontal view of an individual wearing one embodiment of the exercise apparatus of the present invention, for exercising the neck, on their forehead with the apparatus connected to a source of resistance.

According to one embodiment of the present invention, the apparatus is configured especially for strengthening and stretching the neck and related muscle groups at any angle or at several angles. In this embodiment the apparatus includes a headpiece element 100 made up of an inner head ring 110 and an outer halo ring 120. The inner head ring 110, 180 is provided in different shapes and sizes and can be engaged with the outer halo ring 120 though a releasable locking mechanism 140. The inner head ring may engage with the outer halo ring through a plurality of attachment ports. The attachment ports comprise structures 144 on an inner perimeter of the outer halo ring that mate with corresponding structures 142 on an outer perimeter of the inner head ring. These structures of the outer halo ring and corresponding structures of the inner head ring may include uniquely shape protrusions 144 and corresponding grooves 142 to fit the protrusions as shown in FIG. 5, or buttons that snap into position, or clips, or mating strips of materials that adhere to each other, or VELCRO® (trademark) strips, or the like. That is, the structure of the outer ring and the corresponding structure of the inner ring that secure the rings together may be a fastening system including two strips of nylon fabric, one having tiny hooked threads and the other a coarse surface, that form a strong bond when pressed together.

Figure 8:
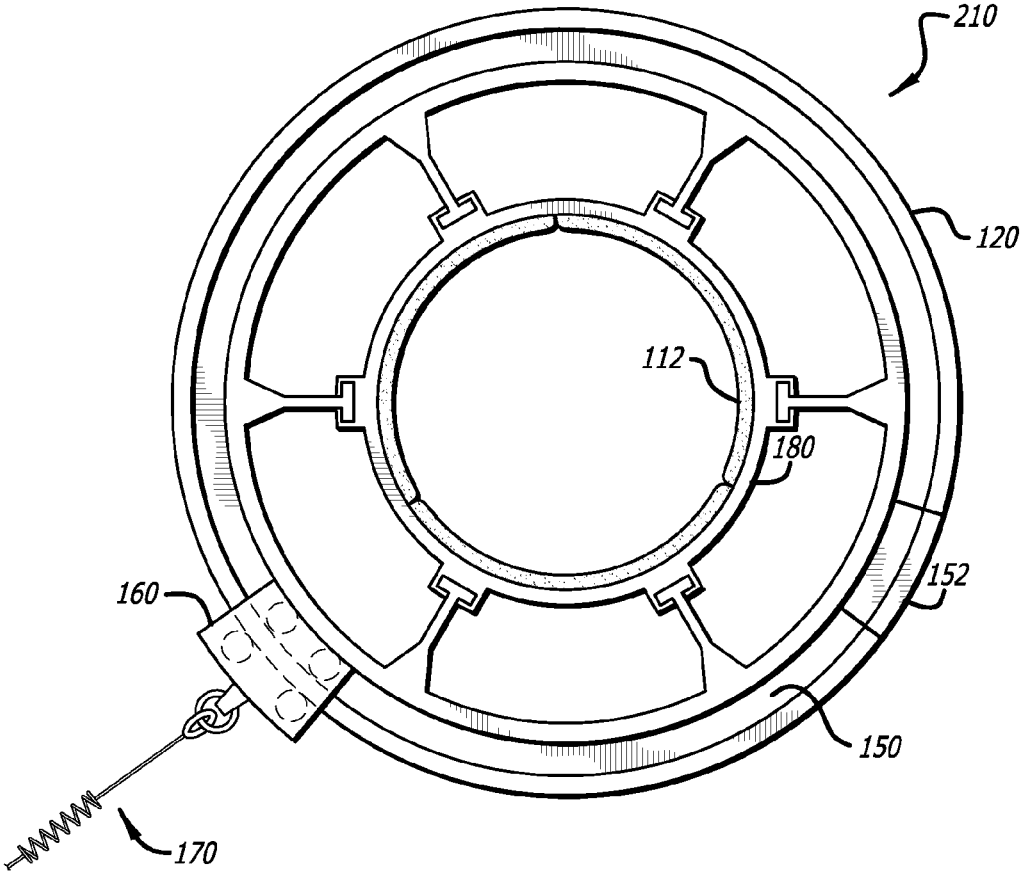
FIG. 8 is a downward view of an embodiment, similar to FIG. 1, but showing a smaller sized inner head ring illustrating that the inner ring may come in a variety of sizes.

The inner head ring may be provided in a variety of sizes and still fit within a uniform outer halo ring by any number of feasible structural adaptations for changing the manner in which the inner ring and outer ring fit together as the size of the inner ring varies. Comparing the headpiece elements 100, 210 of FIG. 1 with FIG. 8 illustrates how inner head rings 110, 180 of different sizes may be accommodated within the same outer ring 120. The headpiece element 100 of FIG. 1 shows an inner head ring 110 of a first size while the headpiece element 210 of FIG. 8 shows an inner head ring 180 of a second smaller size. For example, as shown in FIG. 8, the protrusions extending inward from the outer ring to meet and lock up with corresponding grooves along the smaller inner ring 180 are longer than they are in FIG. 1 to meet and lock up with a larger inner ring 110. The protrusions may be telescopically extendable and retractable to define a circumference of the appropriate size to fit the selected inner ring. Another option for reducing the size of the inner ring to fit a smaller head is to increase the amount of foam padding along the inner perimeter of the inner ring. Alternatively, the inner ring and outer ring may be secured to each other through mating strips having surface texture and/or made of a material such that the strips adhere to each other, for example strips available under the trademark VELCRO®, among other possibilities.

According to one embodiment, the outer halo ring 120 has a plurality of T-shaped protrusions 144 that fit into corresponding T-shape grooves or indentations 142 on the inner head ring 110, 180. The attachment ports between the inner head ring and the outer halo ring may be equally spaced from each other around the perimeter of the rings but need not be. According to one embodiment there are six attachment ports equally spaced around the perimeter of the rings.

For user comfort, the inner head ring that fits around a user's head at the level of the forehead may include foam padding 112 covered with a protective material 114 that is easy to clean, improves durability, and protects the foam. For example, an artificial leather or "pleather" is one example of a suitable cover material outside the foam padding. The inner head ring may be rigid or may be semi-flexible to better conform to the shape of a user's head. The inner head ring may be provided in slightly different shapes to better correspond to the actual shapes of different users' heads. For example, some people may have heads with substantially circular cross-sections while other people have heads with substantially oval or elliptical cross-sections.

Either the inner head ring or the outer halo ring or both may also include one or more straps over the head, closely corresponding to the shape of the head to provide added stability in securing the headpiece apparatus on the head of a user during exercise. According to one embodiment, the inner head ring is provided with two straps that cross each other at a ninety degree angle such that one strap runs from ear to ear of the user and the other strap runs from a front center of a user's head to a back center of a user's head when the inner head ring is correctly positioned on the head of a user.

The outer halo ring includes a channel along an outer perimeter thereof that serves as a guide track 150 for a car 160 that connects the assembly of rings to a source of resistance 170 through an attachment port 166 on the car, as shown in FIG. 2. According to one embodiment, the attachment port is simply a hole on an end of the car, opposite the end of the car that engages the guide track, configured to fit a hook or loop extending from a connector that attaches to a source of resistance.

Figure 3:
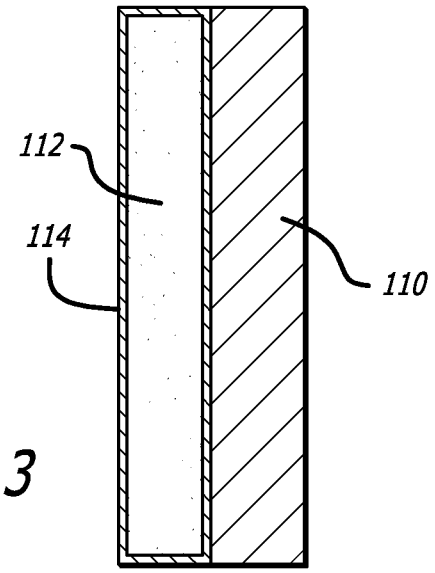
FIG. 3 is a side view of an embodiment showing the foam padding covered with a protective material along an inner surface of the head ring.
Figure 4:
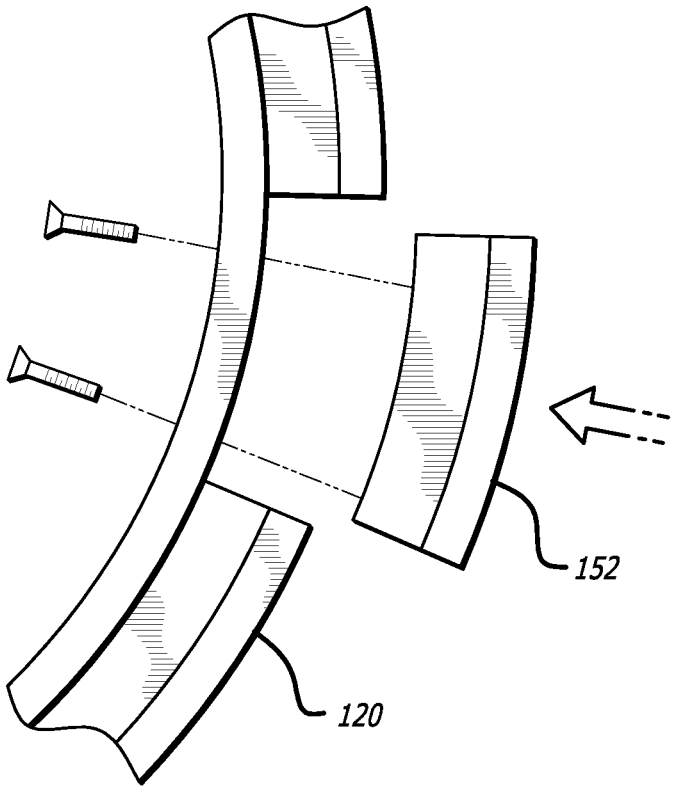
FIG. 4 is a downward view of an embodiment showing how a portion of the guide track may be removed to load or unload the car.

The car may include one or more wheels 162 or other guide elements received by the guide track 150 of the outer ring 120 for moving along it. The wheels or other guide elements may have a lubricious surface 164 by being coated with or otherwise formed from a special low-friction material to facilitate the ability of the car to move easily along the guide track. A section 152 of the guide track may be removable for loading and unloading of the car, as shown in FIG. 4. Alternatively, as shown in FIG. 10, the car may open up or split in half, completely separating into two or more pieces or opening like a mouth about a pivot axis for loading and unloading onto a fixed or integrally formed track.

According to another embodiment of the present invention the apparatus is configured for strengthening and stretching the muscles of another body part at any angle or at several different angles. The exact structure of the embodiment will depend upon the body part desired to be exercised. A unifying principle feature across the various embodiments is a ring configured to fit around a body part having a guide track extending around the ring's outer periphery along which a car connected to a resistance source smoothly rides and adjusts as the user freely moves about.

In certain embodiments the assembly of an inner body part ring provided in a variety of sizes and slightly different shapes and an outer ring with the track may be provided as discussed above for the neck application. In other embodiments a single ring may be provided that fits around the body part and has a guide track built into it around its outer periphery.

Figure 7:
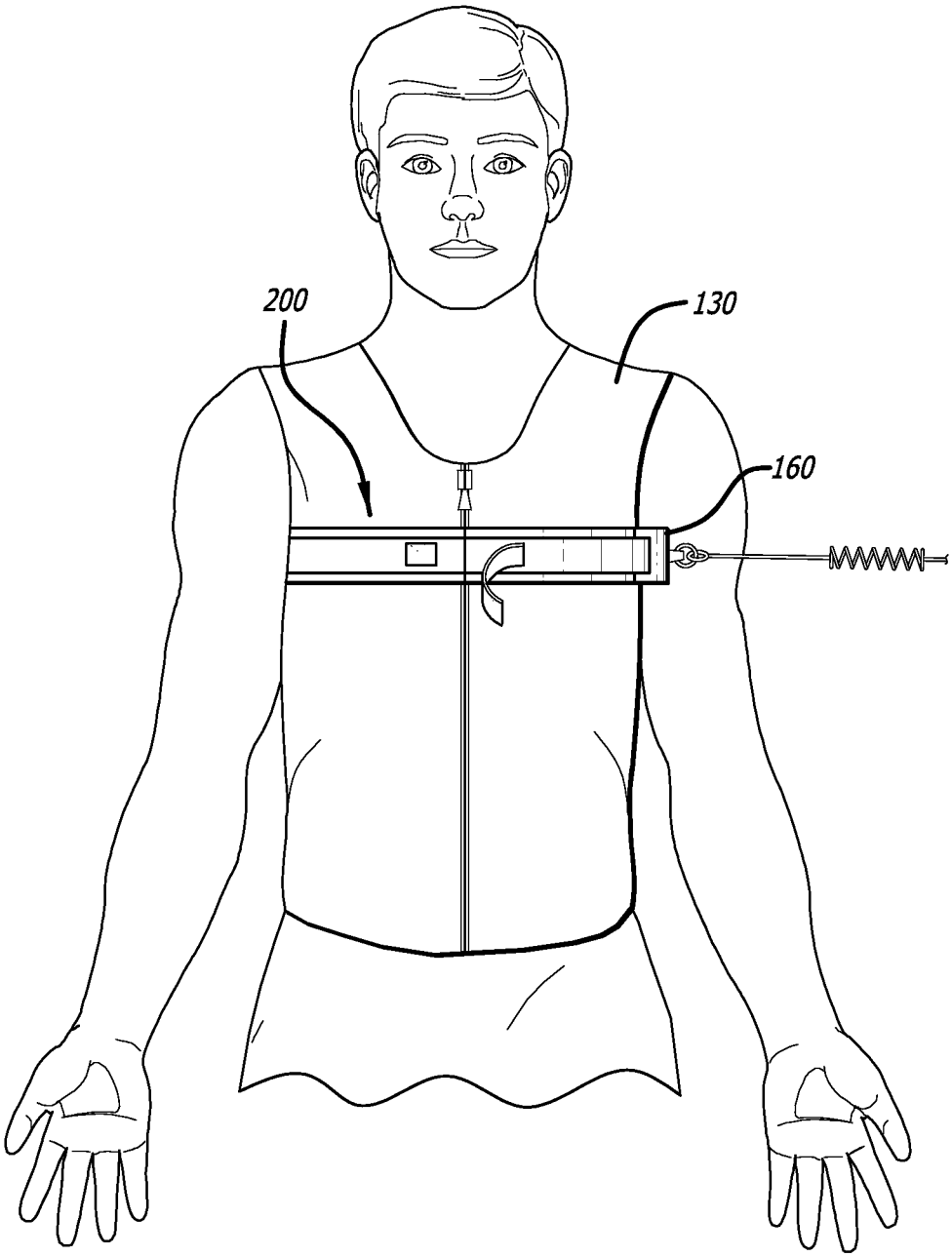
FIG. 7 is a frontal view of an individual wearing another embodiment of the exercise apparatus of the present invention incorporating a harness, for exercising other body parts, around their chest with the apparatus connected to a source of resistance.

As shown in FIG. 7, one specific embodiment provides a means to exercise the body through a chest piece element 200 including a ring or a band placed around the chest. The assembly of outer ring and inner ring may be provided or a single ring may be provided for this embodiment. According to one specific embodiment a variation of the ring assembly is provided in which the inner ring is instead a harness 130 or vest the user wears. In this embodiment, the harness or vest would have structures thereon for engaging with corresponding structures on the outer ring. According to another embodiment, the inner ring is on a harness or vest the user wears but is not itself a harness or vest. According to another embodiment, a single ring is provided having a guide track thereon for wearing around the chest. In any of these embodiments, the harness or inner ring may be made adjustable to fit different users. The harness or inner ring may incorporate VELCRO® (trademark) material, webbing, or similar materials and designs for adjustability.

The embodiments including a ring or assembly of rings around the chest region with or without a harness or vest will find application, for example, for football players on a field doing training drills. With this embodiment, the unpredictable experiences encountered on a field may be simulated by attaching the car riding along a guide track of the ring to a source of resistance. The resistance pulling backwards against the weight of the user simulates other players holding the user back as the user tries to run. The guide track and car assembly provided by the present invention enable the user to freely maneuver at any angle in attempt to break away from real or imagined obstacles. For example, the user may twist from side to side, turn, gallop, sashay, shuffle, run, leap, etc. with the source of resistance pulling back for added challenge. Using a parachute as the source of resistance would be suitable for this application. By wearing the ring having a guide track upon which a car is mounted the user is able to run and even spin or turn in circles without the connection to the source of resistance getting tangled because the car riding around along the guide track simply changes position as necessary to compensate and counter balance the user's movement to maintain a relatively stable position and angle of the car relative to the connector and to the source of resistance. That is, the car moves relative to the guide track but remains in approximately the same position relative to the source of resistance and the connector between the car and the source of resistance.

As shown in FIG. 9, another specific embodiment provides a means to exercise the body, especially the various muscles of the legs and the gluteus maximus muscles of the buttocks, through a waist piece element 300 including a ring or a band placed around the waist. The assembly of outer ring and inner ring may be provided or a single ring may be provided for this embodiment. According to one specific embodiment a variation of the ring assembly is provided in which the inner ring is instead a waistband or belt the user wears. In this embodiment, the waistband or belt would have structures thereon for engaging with corresponding structures on the outer ring. According to another embodiment, the inner ring is on a waistband or belt the user wears but is not itself a waistband or belt. According to another embodiment, a single ring is provided having a guide track thereon for wearing around the waist. In any of these embodiments, the waistband, belt, or inner ring may be made adjustable to fit different users. The waistband, belt, or inner ring may incorporate VELCRO® (trademark) material, webbing, or similar materials and designs for adjustability.

Figure 11A:
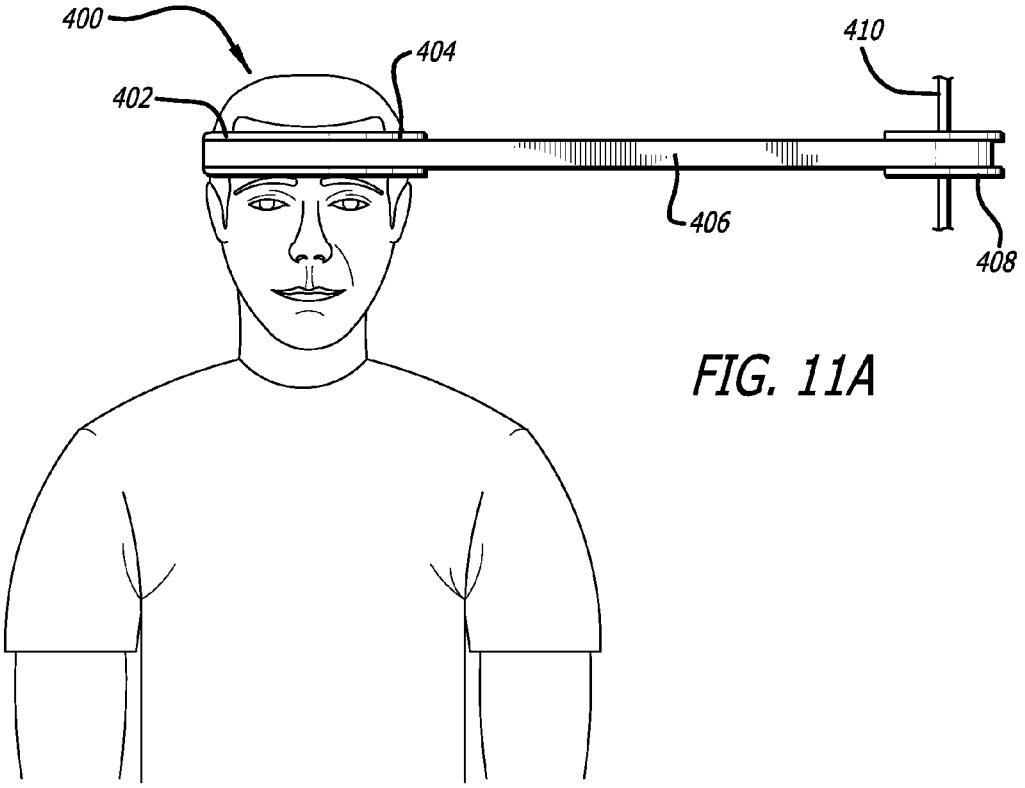
FIG. 11A is a frontal view of an individual wearing an embodiment in which a resistive band is supported between a guide track in a head ring and a pulley.
Figure 11B:
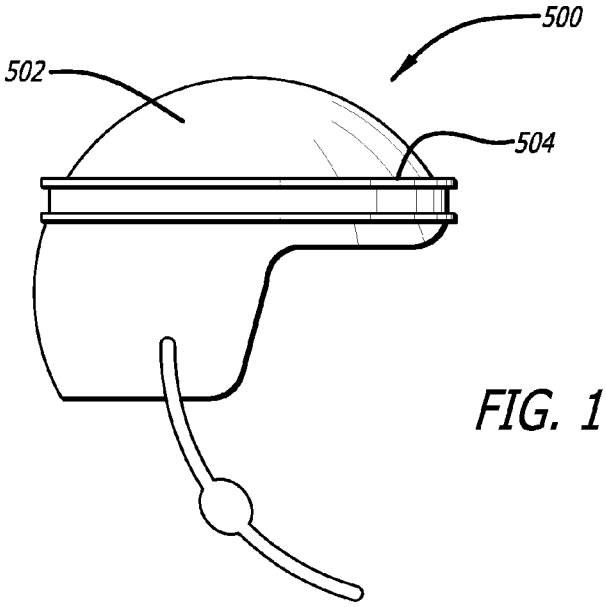
FIG. 11B is a side view of an another embodiment for the head ring of FIG. 11 in which the guide track is formed within a helmet rather than a forehead band.

With regard to FIGS. 11A and 11B, a device for exercising the neck muscles is shown that includes a track in a head ring around the head at the level of the forehead. The head ring track may be included as a forehead band or mounted on or formed in a helmet. A section of the resistive band fits within the track of the head ring at one end. Another section of the resistive band at the other end fits around a pulley or other stabilizing device. The pulley may be configured to move up or down along an axis pole. The resistive band may move or slide around within the track but need not. As the individual moves the head forward, backward, from side to side, or in any direction, the resistive band exerts pressure against the head and neck muscles which are in turn stretched and strengthened. The head ring may be adjusted to fit heads of variable sizes with buckles or reusable mating materials including those available under the trade name VELCRO®.

More specifically, FIG. 11A shows a forehead band embodiment 400 including a forehead band 402 having a guide track 404 therein. The resistive band 406 is positioned to rest within the guide track. Resistance for stretching and strengthening is provided by placing the resistive band under tension created by the forehead band at one end and a pulley 408 disposed along an axis pole 410 at the other end. FIG. 11B illustrates a helmet embodiment 500, which is a variation of the head ring as an alternative to the forehead band embodiment. The guide track 504 is disposed within or mounted upon an outer perimeter of a helmet 502 rather than a forehead band.

A variation of the basic structure of the embodiment shown in FIGS. 11A and 11B for the head can be used around the waist. Such a variation could include the track being formed within a belt, girdle, or torso brace.

Figure 12A:
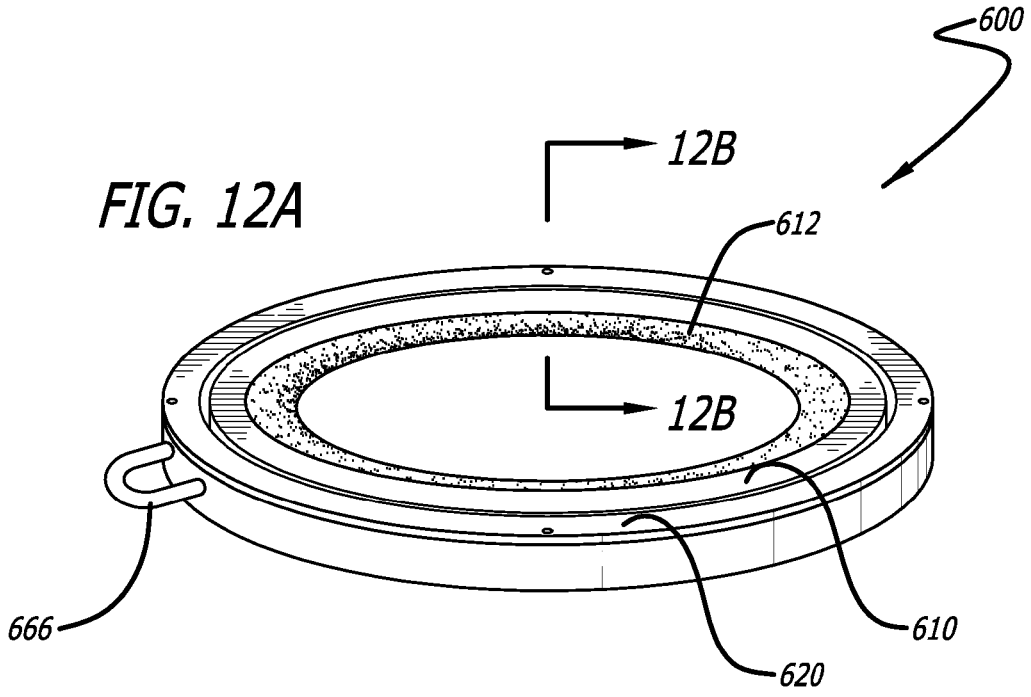
FIG. 12A is a perspective view of another embodiment in which the outer ring and attachment port are stationary relative to an inner ring that rotates, the inner ring or padding connected to it being inflatable.
Figure 12B:
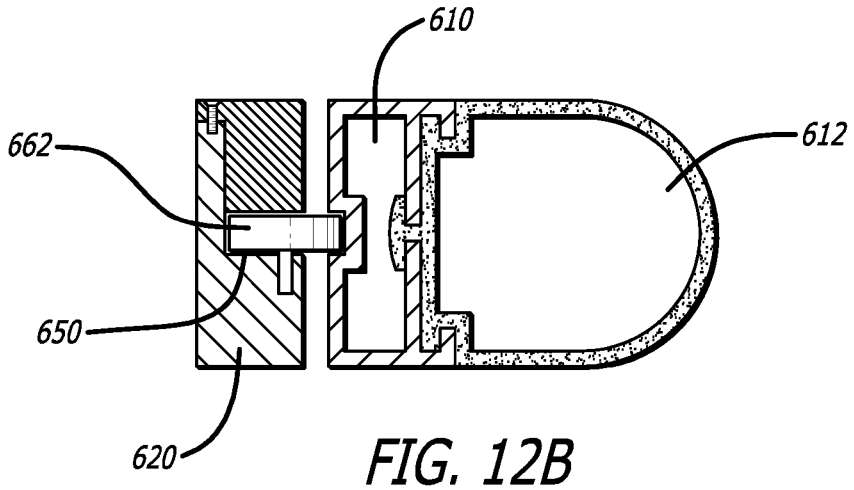
FIG. 12B is a cross-sectional view along lines 12B of FIG. 12A.

FIGS. 12A and 12B illustrate yet another variation of the basic dual ring design in which the attachment port 666 on the outer ring 620 and the outer ring are stationary while the inner ring 610 includes one or more bearings or wheels 662 thereon to rotate 360 degrees along a track 650 on an inner surface of the outer ring. The attachment port on the outside of the outer ring may be attached to a stationary object or held by a person, either via a cord or a bungee. Along the inside surface of the inner ring, padding or an inflatable bladder 612 is provided for a more precise and more comfortable fit.

Figure 14C:
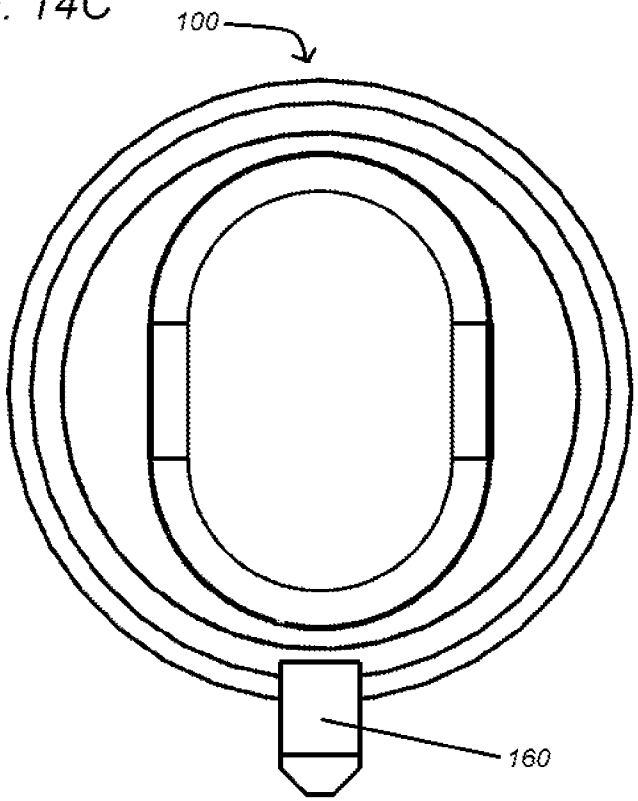
FIG. 14C is a cross-sectional view of an embodiment having a car similar to that shown in FIG. 1 but with the peripheral shape of the inner ring resembling two symmetric half circles joined at top and bottom by parallel lines.
Figure 14D:
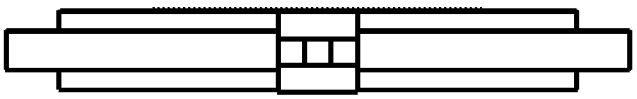
FIG. 14D is a side view of FIG. 14C.
Figure 14A:
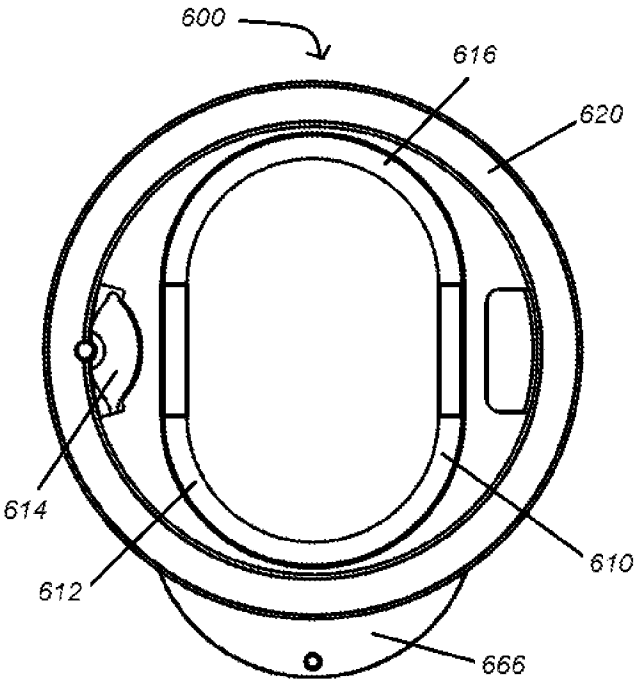
FIG. 14A is a cross-sectional view of an embodiment similar to that shown in FIG. 12A but with the peripheral shape of the inflatable inner ring resembling two symmetric half circles joined at top and bottom by parallel lines.
Figure 14B:
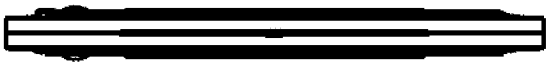
FIG. 14B is a side view of FIG. 14A.

While the rings can be circular as shown in FIGS. 1, 8 and 12A, in other embodiments the shape of the inner ring is ergonomically design to better fit around an individual user at the hip level. For example, as shown in FIGS. 14A and 14C the inner ring may be formed in the shape of two symmetric half circles 616 joined by parallel straight lines at the top and bottom. In this variation, the configuration of the outer ring may also be in this shape of symmetric dual half circles joined by parallel lines or the outer ring may be circular with the border filled in to cover the space between the circular configuration of the outer ring and the non-circular configuration of the inner ring.

Figure 13:
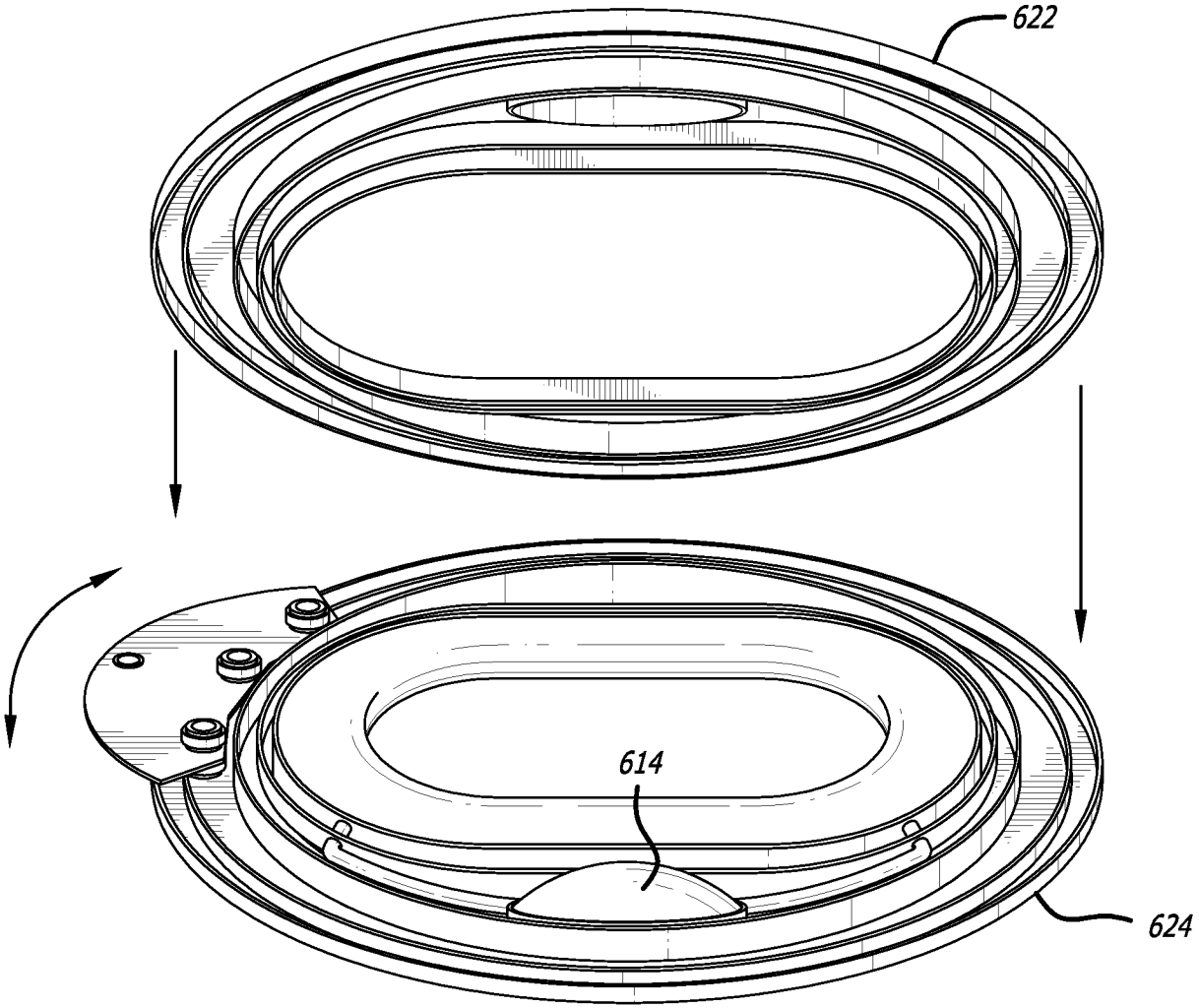
FIG. 13 is a perspective view of an embodiment similar to that shown in FIG. 12A but opened up to illustrate assembly and with the peripheral shape of the inflatable inner ring resembling two symmetric half circles joined at top and bottom by parallel lines.

Referring now to FIG. 13, the dual ring configuration may be assembled by sandwiching together two halves of the outer ring, an upper half 622, and a lower half 624. In one such embodiment, the attachment port can be sandwiched in between the two halves, a position in which it is protected and less in the way of an exerciser using the apparatus compared to mounting the attachment port on the outside of the outer ring.

In one particular embodiment of the outer ring of the dual rings being assembled like a sandwich, in which the attachment port moves, the piece upon which the attachment port is located may be secured within a track of the outer ring through wheel bearings similar to those used for skateboards (e.g. standard size 608 skate bearings).

In some embodiments, the individual pieces that form the outer ring may be injection molded and the inner ring may be an inflatable roto cast belt. In other variations additional intermediate ring pieces may be provided between the inner ring or inflatable belt and the outer ring to further adjust the size to accommodate users of varying dimensions.

The pump 614 for inflation of the inner ring or the inflatable padding inside the inner ring may be mounted between the two halves of the outer ring, as shown in FIG. 13, and should be configured for storage in an unobtrusive position where it won't both a user exercising with the device. A quick release button should be provided to rapidly eliminate air from the chambers. This facilitates quick removal of the exercise ring. Friction crush fasteners can be used throughout the assembled device as a substitute for more traditional screws. Additionally, a band may be provided along the outside of the outer ring for display of graphics, names, or images, including brand names, manufacturer names, and company sponsors.

The embodiments including a ring or assembly of rings around the waist region with or without a waistband or belt will find application, for example, in group exercise classes including group aerobics. With this embodiment, several individuals and a group exercise class instructor may each wear the exercise belt around the waist with the car on the ring or outer ring attached to a bungee cord and the bungee cord held to a wall or other heavy, stable structure. The bungee cord and wall or column provide the needed resistance for stretching and strengthening muscles. The class instructor can lead the class members through a series of moves that include twisting, turning, moving forward, moving backward, moving from side to side, squatting, lunging, leaping, pivoting, etc. and each exerciser will be able to move freely on account of the mobile car secured to the guide track on the ring, outer ring, exercise belt, or waistband.

The apparatus in accordance with the present invention is configured for use with a source of resistance that may include any one or more of the following: a bungee cord, a kettlebell, a cable cross over machine, a pilates machine, weight stacks, a wall, a column, a parachute, another person, a tree trunk, a tree branch, a fence, a post, and the like. It can include objects typically found at a gym as well as those found in nature or at outdoor sites.

According to another application of the apparatus in accordance with an embodiment the present invention, the source of resistance is a kettlebell to provide extreme conditioning. With the individual standing substantially stationary, the body part with the ring around it may be gyrated or whirled in a substantially circular motion or pivoted from side to side to move the kettlebell on the floor through the mobile car mounted on the ring.

Specific examples of workouts that can be performed with the halo-like apparatus for exercising the neck include turning to the left then to the right, moving the head back and forth along a diagonal (nose up, nose down), spinning around, lunging while performing any of the previous head motions, movements emulating those which occur on the football field and standard football drills, movements emulating those which occur in the wrestling ring and standard wrestling drills, movements emulating those which occur in other sports and standard drills for other sports, twisting the head back and forth while doing push-ups or sit-ups or pull-ups, figure eight motions, multifunctional workouts that incorporate other exercise equipment (e.g. inflatable exercise balls), and the like. In one particular example of the situation in which another person provides the source of resistance, the other person can also be wearing an exercise device in accordance with the present invention such that each person wearing a device provides a reciprocal source of resistance to the other. In this manner, two exercisers can perform a mirror drill in which they mimic each other's motions.

The present invention is not limited to the embodiments described above. Various changes and modifications can, of course, be made, without departing from the scope and spirit of the present invention. Additional advantages and modifications will readily occur to those skilled in the art. Accordingly, various modifications may be made without departing from the spirit or scope of the general inventive concept as defined by the appended claims and their equivalents.

I claim:

1. An apparatus for exercising a user's body part, comprising:

a closed loop element formed by an outer ring and an inner ring configured to completely encircle the user's body part, the closed loop element having an outer surface defining a guide track therein, wherein the closed loop element remains secured around the user's body part without requiring the user to hold the closed loop element in place;

and a car having an attachment port for connection to a source of resistance, the car configured to fit within the guide track and to move along the guide track, wherein the car includes two or more completely separable pieces and is configured to open up and completely separate into the two or more separable pieces for loading and unloading about the guide track.

2. The apparatus of claim 1, wherein at least a section of the guide track is removable from the inner ring for the loading and unloading of the car.

3. The apparatus of claim 1, wherein the source of resistance has a circular perimeter.

4. The apparatus of claim 3, wherein the source of resistance comprises a pulley.

5. The apparatus of claim 4, wherein the pulley is mounted along an axis pole and rotatable around the axis pole.

6. An apparatus for exercising a body part of a user, comprising:

a first inner ring configured to be worn around the body part of the user, the first inner ring having an outer surface, wherein an inner surface of the first inner ring is configured to be in direct contact with the body part of the user;

a second outer ring also configured to be worn around the body part of the user outside of the first inner ring, the second outer ring having an outer surface and an inner surface defining a guide track therein;

and a car having an attachment port for connection to a source of resistance, the car configured to fit within the guide track and to move along the guide track, wherein the car includes two or more completely separable pieces and is configured to open up and completely separate into the two or more separable pieces for loading and unloading about the guide track.

7. The apparatus of claim 6, wherein the second outer ring is stationary and the first inner ring is moveable, the first inner ring configured to rotate relative to the second outer ring as the body part rotates, and wherein at least a section of the guide track is removable from the first inner ring for the loading and unloading of the car.

8. The apparatus of claim 6, further comprising an inflatable bladder inside the first inner ring, wherein an effective size of the apparatus is adjustable to properly fit the body part of the user by inflating or deflating the inflatable bladder, and wherein a quick release button rapidly eliminates air from the inflatable bladder.

9. The apparatus of claim 8, wherein the inflatable bladder is at least a portion of the first inner ring itself.

10. The apparatus of claim 8, wherein the inflatable bladder is a separate element connected to the inner surface of the first inner ring.

11. The apparatus of claim 6, wherein the second outer ring comprises a top portion and a bottom portion, the separation of which reveals horizontal cross-sections, the top portion and the bottom portion being mated together to assemble the second outer ring.

12. The apparatus of claim 11, wherein the attachment port is sandwiched between the top portion and the bottom portion of the second outer ring.

* * * * *